US008469728B1

(12) United States Patent
Luksic et al.

(10) Patent No.: US 8,469,728 B1
(45) Date of Patent: Jun. 25, 2013

(54) POLARITY PROTECTION FOR ELECTRIFIED GRID AND MATING CONNECTOR

(75) Inventors: Marek T. Luksic, Dillsburg, PA (US); Philip Clay Brandberg, Carlisle, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/309,609

(22) Filed: Dec. 2, 2011

(51) Int. Cl.
*H01R 25/00* (2006.01)

(52) U.S. Cl.
USPC ..... 439/116

(58) Field of Classification Search
USPC ..... 439/116, 121, 122, 404, 118, 217
See application file for complete search history.

(56) References Cited

U.S. PATENT DOCUMENTS

| | | | | |
|---|---|---|---|---|
| 2,924,687 | A | 2/1960 | Platz | |
| 3,710,530 | A | 1/1973 | Valtonen | |
| 3,813,633 | A | 5/1974 | Clement | |
| 3,898,782 | A | 8/1975 | Donato | |
| 4,088,293 | A | 5/1978 | Delmore | |
| 4,108,523 | A * | 8/1978 | Bolis | 439/116 |
| 4,203,053 | A | 5/1980 | Shepard | |
| 4,218,108 | A | 8/1980 | El Mouchi | |
| 4,286,419 | A | 9/1981 | Treffers | |
| 4,646,212 | A | 2/1987 | Florence | |
| 4,699,439 | A | 10/1987 | Cohen | |
| 4,736,564 | A | 4/1988 | Gailey | |
| 4,831,273 | A | 5/1989 | Ross et al. | |
| 5,033,247 | A | 7/1991 | Clunn | |
| 5,072,344 | A | 12/1991 | Fabbri | |
| 5,334,037 | A | 8/1994 | Gabrius, Algimantas J. et al. | |
| 5,390,461 | A | 2/1995 | Dwyer | |
| 5,561,271 | A | 10/1996 | Bruck et al. | |
| 5,653,412 | A | 8/1997 | Martorano et al. | |
| 5,788,518 | A | 8/1998 | Wachter et al. | |
| 5,855,485 | A | 1/1999 | Patti | |
| 6,004,005 | A | 12/1999 | Demshki, Jr. | |
| 6,079,992 | A | 6/2000 | Kuchar et al. | |

(Continued)

FOREIGN PATENT DOCUMENTS

| | | | |
|---|---|---|---|
| DE | 10300857 | A1 | 7/2004 |
| DE | 202005020919 | U1 | 12/2006 |

(Continued)

OTHER PUBLICATIONS

International Search Report, International Application No. PCT/US2012/066028, International Filing Date, Nov. 20, 2012.

(Continued)

*Primary Examiner* — Jean F Duverne

(57) ABSTRACT

A connector, an electrified grid element and the combination. First and second contacts with first and second contact portions are secured in the housing of the connector. The second contact portion is offset from a first surface of the connector a greater distance that the first contact portion. An electrified grid has a first conductor and a second conductor, with the first conductor having an opposite polarity to the second conductor. A first insulator member is positioned proximate the first conductor and a second insulator member is positioned proximate the second conductor. The first and second insulator members prevent the mating of the connector to the electrified grid unless the connector is properly oriented in the electrified grid, thereby insuring proper polarity between the connector and the electrified grid.

20 Claims, 7 Drawing Sheets

U.S. PATENT DOCUMENTS

| | | | | |
|---|---|---|---|---|
| 6,170,967 | B1 | 1/2001 | Usher et al. | |
| 6,203,339 | B1 * | 3/2001 | Nieminen | 439/118 |
| 6,857,883 | B2 | 2/2005 | Tang | |
| 6,884,095 | B1 | 4/2005 | Tsai | |
| 7,351,075 | B1 | 4/2008 | Patterson et al. | |
| 7,520,763 | B1 * | 4/2009 | Buse | 439/121 |
| 7,758,358 | B1 | 7/2010 | Mier-Langner et al. | |
| 8,274,007 | B2 * | 9/2012 | Blalock et al. | 218/129 |
| 2003/0137835 | A1 | 7/2003 | Mier-Langner et al. | |
| 2004/0213003 | A1 | 10/2004 | Lauderdale et al. | |
| 2006/0035518 | A1 | 2/2006 | Hueber | |
| 2006/0272256 | A1 | 12/2006 | Frecska et al. | |
| 2007/0103824 | A1 | 5/2007 | Patterson et al. | |
| 2008/0087464 | A1 | 4/2008 | Patterson et al. | |
| 2008/0090432 | A1 | 4/2008 | Patterson et al. | |
| 2009/0162051 | A1 * | 6/2009 | Hudgins et al. | 398/9 |
| 2010/0015824 | A1 | 1/2010 | Wang et al. | |

FOREIGN PATENT DOCUMENTS

| | | | |
|---|---|---|---|
| EP | 0 322 203 | A2 | 6/1989 |
| EP | 0560445 | A1 | 9/1993 |
| EP | 1 076 384 | A1 | 2/2001 |
| EP | 2 248 503 | A1 | 11/2010 |
| EP | 2249442 | A1 | 11/2010 |
| FR | 2832748 | A1 | 5/2003 |
| GB | 1 588 540 | A | 4/1981 |
| WO | 98/51963 | A2 | 11/1998 |
| WO | 2009/128909 | A1 | 10/2009 |

OTHER PUBLICATIONS

International Search Report, International Application No. PCT/US2012/066089, International Filing Date, Nov. 20, 2012.

International Search Report, International Application No. PCTUS2012/066170, International Filing Date, Nov. 21, 2012.

* cited by examiner

POLARITY PROTECTION FOR ELECTRIFIED GRID AND MATING CONNECTOR

FIELD OF THE INVENTION

The present invention is directed to the electrical connection between an electrified grid and a connector attached thereto, and, more particularly, to providing polarity protection to the grid and/or connector to insure that the grid and connector will only be placed in electrical engagement when properly oriented.

BACKGROUND OF THE INVENTION

The electrical grid connecting America's power plants, transmission lines and substations to homes, businesses and factories operate almost entirely within the realm of high voltage alternating current (AC). Yet, an increasing fraction of devices found in those buildings actually operate on low voltage direct current (DC). Those devices include, but are not limited to, digital displays, remote controls, touch-sensitive controls, transmitters, receivers, timers, light emitting diodes (LEDs), audio amplifiers, microprocessors, other digital electronics and virtually all products utilizing rechargeable or disposable batteries.

Installation of devices utilizing low voltage DC has been typically limited to locations in which a pair of wires is routed from the voltage source. Increased versatility in placement and powering of low voltage DC products is desirable. Specifically, there is an increasing desire to have electrical functionality, such as power and signal transmission, in the interior building environment, and specifically in the ceiling environment, without the drawbacks of existing systems.

Commercial building spaces such as offices, laboratories, light manufacturing facilities, health facilities, meeting and banquet hall facilities, educational facilities, common areas in hotels, apartments, retirement homes, retail stores, restaurants and the like are commonly constructed with suspended ceilings. These suspended ceiling installations are ubiquitous, owing to their many recognized benefits. Such ceilings ordinarily comprise a rectangular open grid suspended by wire from a superstructure and tile or panels carried by the grid and enclosing the open spaces between the grid elements.

Many relatively low power devices are now supported on such ceilings and newer electronic devices and appliances are continuously being developed and adopted for mounting on ceilings. The ceiling structure, of course, typically overlies the entire floor space of an occupiable area. This allows the ceiling to support electronic devices where they are needed in the occupied space. Buildings are becoming more intelligent in energy management of space conditioning, lighting, noise control, security, and other applications. The appliances that provide these features including sensors, actuators, transducers, speakers, cameras, recorders, in general, all utilize low voltage DC power.

A conventional grid framework, such as one used in a surface covering system, includes main grid elements intersected by cross grid elements therebetween. The main and cross elements form a grid of polygonal openings into which components such as panels, light fixtures, speakers, motion detectors and the like can be inserted and supported. Known systems that provide electrification to devices, such as lighting components, in conventional framework systems utilize a means of routing discrete wires or cables, principally on an "as needed" point-to-point basis via conduits, cable trays and electrical junctions located in the space behind the grid framework.

These known systems suffer from the drawback that the network of wires required occupy the limited space behind the grid framework and are difficult to service or reconfigure. Moreover, the techniques currently used are limited in that the electricity that is provided is not reasonably accessible from all directions relative to the framework plane. For example, electricity can be easily accessed from a ceiling plenum, but not from areas within or below the plane of the grid framework of a suspended ceiling system. Further, the electrical power levels that are typically available are not safe to work with for those not trained, licensed and/or certified.

In known systems utilizing track systems, the connecting devices have terminals that provide electrical connections to conductors provided in a track. These tracks also typically require wiring and mechanical support from the area behind the grid framework. In addition, existing track systems are typically viewable from the room space and are aesthetically undesirable. Further still, known track systems typically utilize higher voltage AC power and connect to AC powered devices, requiring specialized installation and maintenance.

In an effort to overcome some of the problems with prior systems, internal bus bars have been positioned in the ceiling grid. One such system is described in the documents related to the Emerge Alliance. Such systems provide electrical power through two parallel bus bars embedded with the support rails of a suspended ceiling. However, the bus bar electrical connection points are symmetrically arranged without any visual or mechanical indication of the polarity orientation. Therefore, devices which are connected to the bus bars must be correctly oriented with corresponding electrical polarity or employ some type of secondary polarity protection/compensation scheme.

What is needed is a means to insure that the polarity of the connectors is properly oriented when the connectors are electrically connected to the bus bars, thereby eliminating the need for secondary polarity protection. The present invention accomplishes this need and provides additional advantages.

SUMMARY OF THE INVENTION

An exemplary embodiment is directed to a connector for installation on a ceiling grid having conductors therein. The connector has a housing having a first surface. A first contact is secured in the housing. The first contact has a first contact portion which extends from the first surface. A second contact is secured in the housing. The second contact has a second contact portion which extends from the first surface. The second contact portion is offset from the first surface a greater distance than the first contact portion. The first and second contact portions will only be placed in electrical connection with respective connection points of the conductors of the ceiling grid when the first and second contact portions are properly aligned, thereby insuring proper polarity between the first and second contact portions and the conductors.

An exemplary embodiment is also directed to an electrified grid element. The grid element has a base wall, two side walls extending from the base wall, and flanges extending from the side walls. A first conductor is positioned proximate a first respective side wall and a second conductor is positioned proximate a second respective side wall. The first conductor has an opposite polarity to the second conductor. Insulator members are positioned proximate the side walls. The insulator members cooperate with a mating connector to prevent the mating connector from engaging the first and second conductors if the polarity of the mating connector does not correspond to the polarity of the first and second conductors.

An exemplary embodiment is also directed to a connection system having a connector and an electrified grid element. The connector has a housing with a first surface. A first contact is secured in the housing. The first contact has a first contact portion which extends from the first surface. A second contact is secured in the housing. The second contact has a second contact portion which extends from the first surface. The second contact portion is offset from the first surface a greater distance that the first contact portion. The electrified grid element has a first conductor and a second conductor, with the first conductor having an opposite polarity to the second conductor. A first insulator member is positioned proximate the first conductor and a second insulator member is positioned proximate the second conductor. The first insulator member is offset from the first surface of the housing a greater distance than the second insulator member. The first and second insulator members prevent the mating of the connector to the electrified grid element unless the connector is properly oriented in the electrified grid member, thereby insuring proper polarity between the connector and the electrified grid element.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
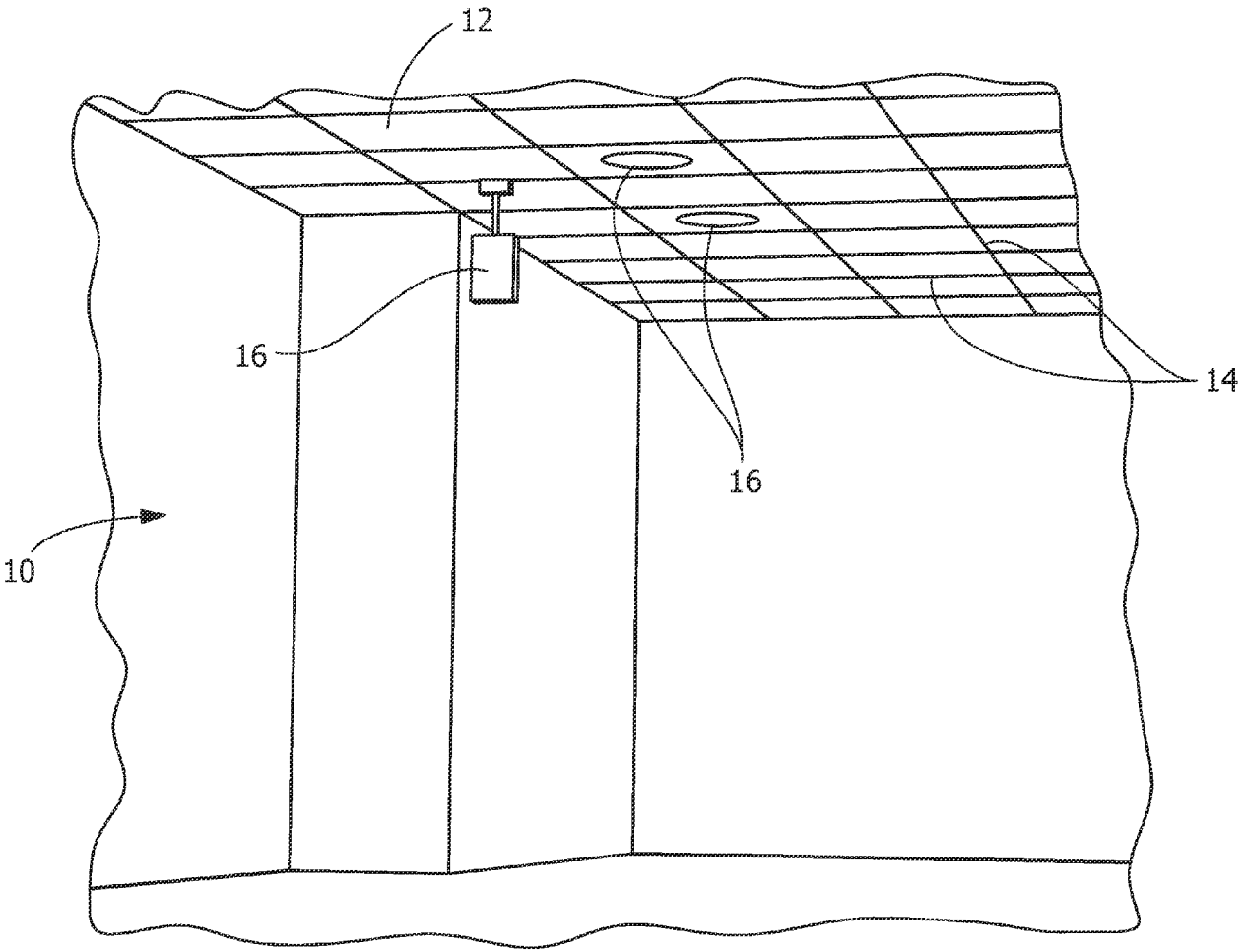
FIG. 1 shows a perspective view of a room space having an electrified ceiling according into which a connector can be inserted and electrically engaged.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

The present invention is directed to an electrified grid, insulators for use with bus bars or conductors to insure proper orientation of a mating connector, and to connectors for use with an electrified framework or ceiling grid. For illustrative purposes, FIG. 1 shows a room space 10 having a ceiling 12 supported by a ceiling grid framework 14. However, any system having a grid framework, including floors and wall, can utilize the technology of the invention. The ceiling 12 may include decorative tiles, acoustical tiles, insulative tiles, lights, heating ventilation and air conditioning (HVAC) vents, other ceiling elements or covers and combinations thereof. Power for low voltage devices 16 attached to or suspended from the ceiling 12 or framework 14 is provided by the conductive material placed upon the ceiling grid framework 14. Low voltage devices 16, such as, but not limited to, light emitting diode (LED) lights, speakers, smoke or carbon monoxide detectors, wireless access points, still or video cameras, or other low voltage devices, may be utilized with the electrified ceiling.

Figure 2:
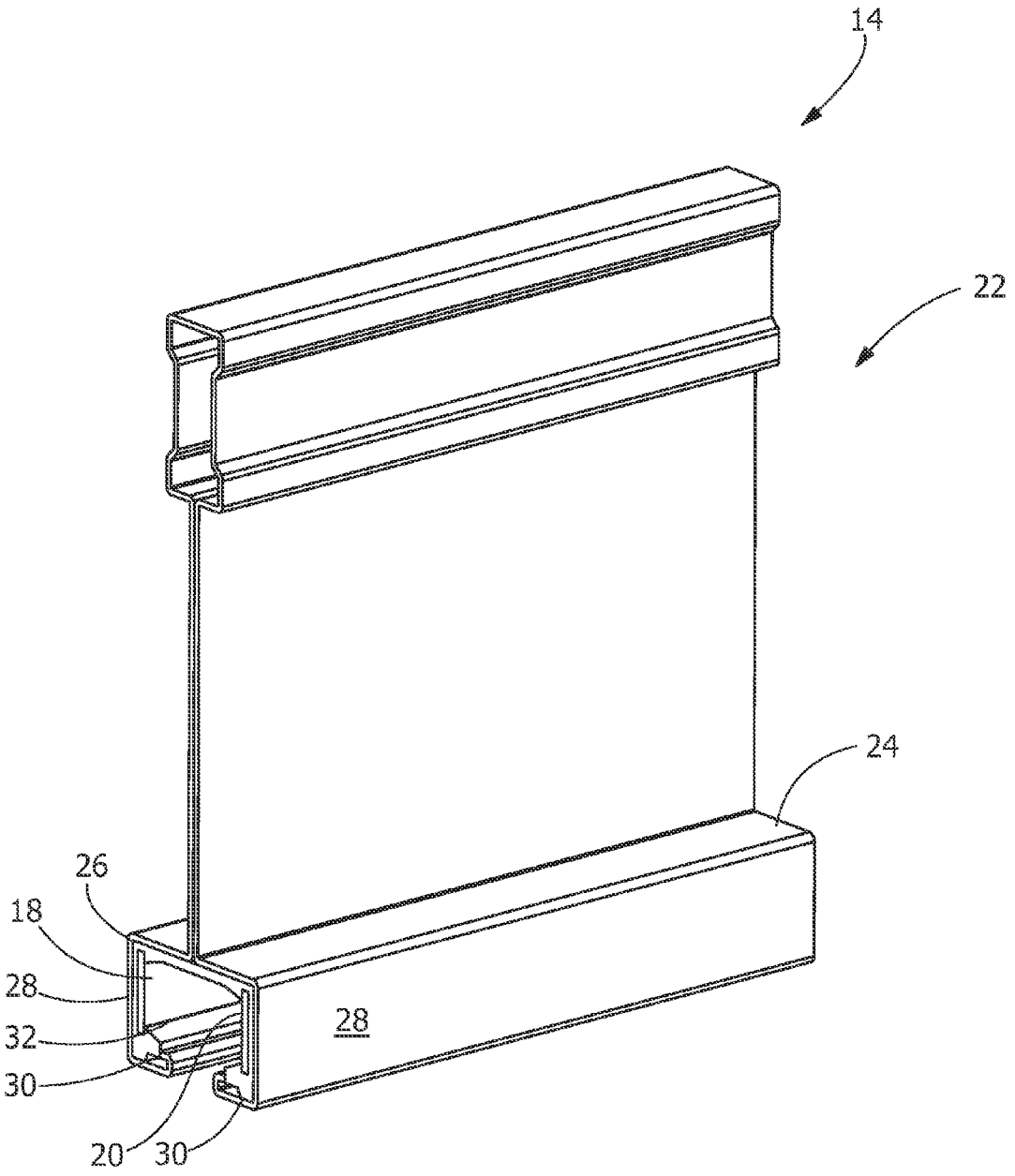
FIG. 2 shows a perspective view of a section of an exemplary grid member which can be used in the electrified ceiling of FIG. 1.
Figure 3:
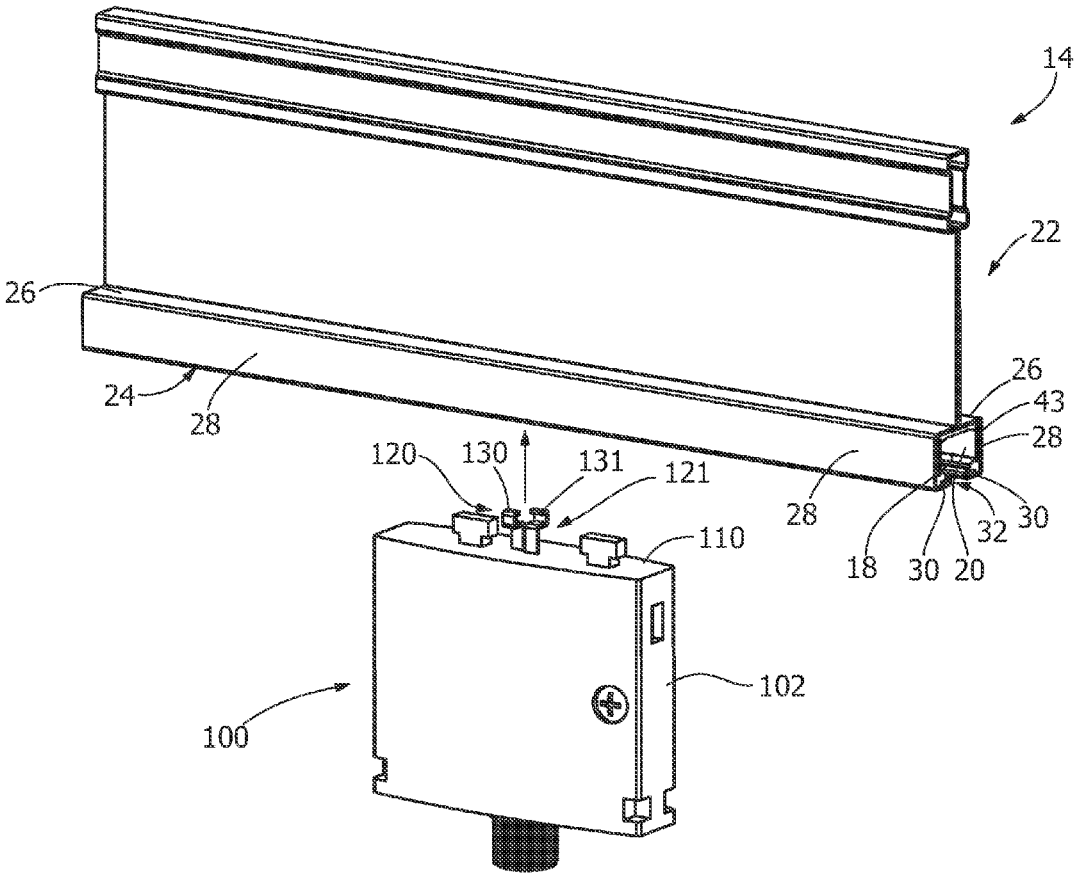
FIG. 3 shows a perspective view of an exemplary connector prior to insertion into the grid member.

In the exemplary embodiment shown, conductive material is disposed on a surface of at least one of the plurality of grid members. In the exemplary embodiment shown in FIG. 2, first and second bus bars, conductive strips or conductors 18 and 20 are disposed on a grid element 22 of the grid framework 14. In the exemplary embodiment shown, the conductors 18, 20 are strips which are spaced from each other and which extend essentially parallel to each other. The conductors 18, 20 have opposite polarity, i.e. one is positive and one is negative. The conductors 18, 20 are housed inside the lower box 24 of the grid element 22. More specifically, in the exemplary embodiment shown, the conventional lower box 24 configuration typically has a base wall 26, a pair of side walls 28 and a pair of flanges 30 that define a slot 32 therebetween. Conductors 18, 20 which are positioned on respective surfaces of the pair of sidewalls 28.

Insulator members 40, 42 are positioned proximate the conductors 18, 20. The insulator members 40, 42 may be made of any material which has the nonconductive properties required, such as, but not limited to, extruded plastic material. The insulator member 40 extends from proximate the flange 30 and extends from proximate the conductor 18 toward conductor 20. The insulator member 42 extends from proximate the base wall 26 and extends from proximate the conductor 20 toward conductor 18.

The insulator members 40, 42 may be an integrally molded component of the plastic isolation member 43 which provides electrical isolation between the conductors 18, 20 and the metal grid element 22. In the exemplary embodiment shown, the isolation member 43 and insulator members 40, 42 are extruded molded. However, other known molding methods may be used. Additionally, insulator members may be separate pieces which are attached to the isolation member 43 using known methods, such as, but not limited to, the use of an adhesive.

Figure 4:
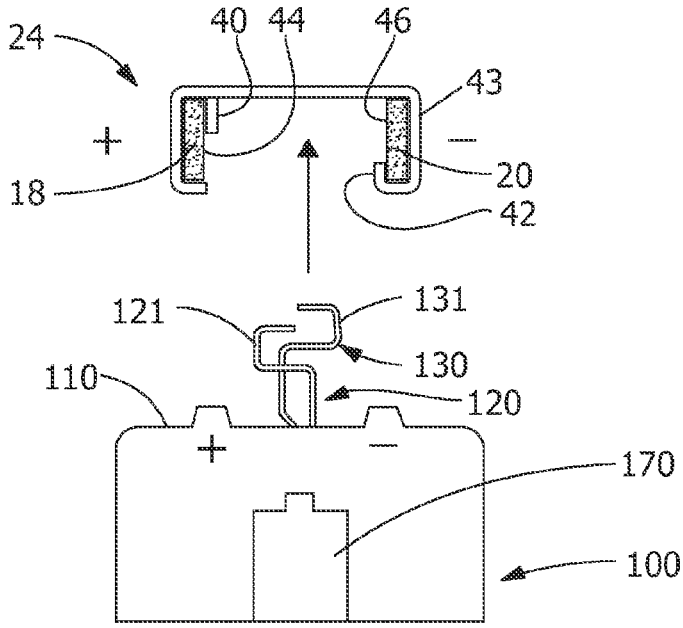
FIG. 4 shows an enlarged end view of a top portion of the connector of FIG. 3 prior to insertion into the grid member which has bus bars provided thereon.
Figure 5:
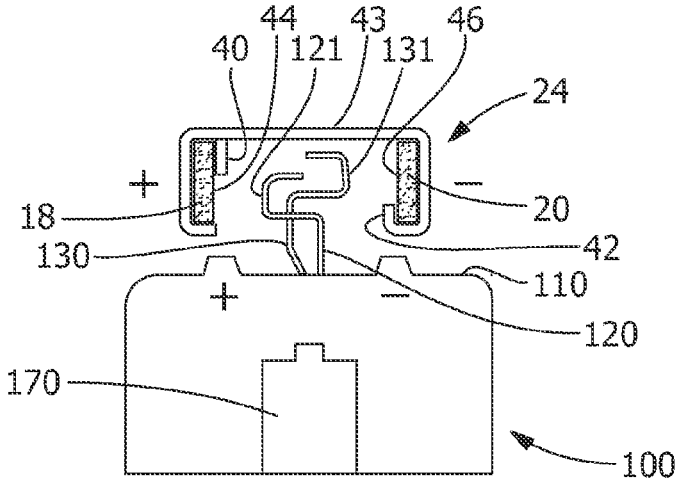
FIG. 5 shows an enlarged end view of the top portion of the connector with contacts inserted into the grid member.
Figure 6:
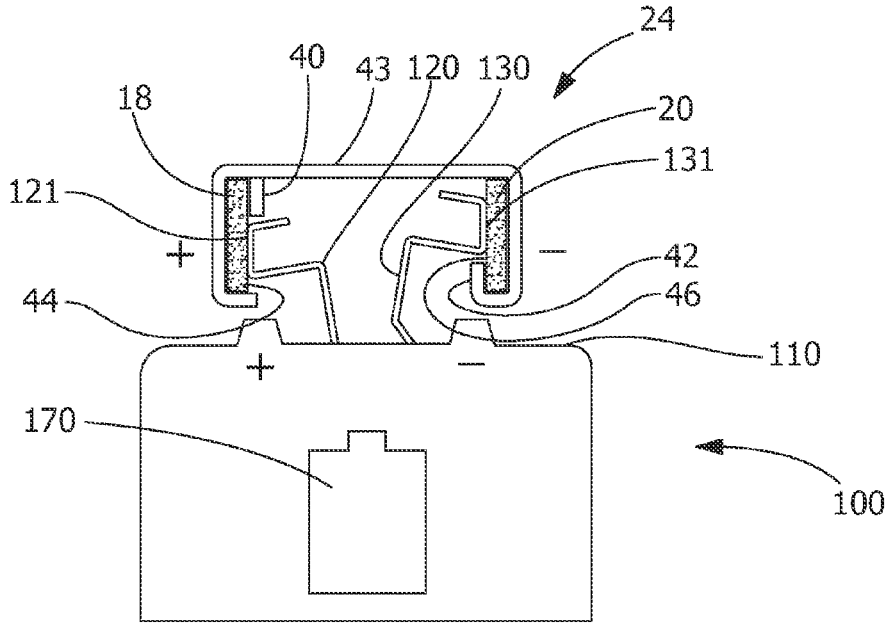
FIG. 6 shows an enlarged end view of the top portion of the connector with the contacts spread apart to make an electrical connection with the bus bars.

In the exemplary embodiment shown in FIGS. 4 through 6, the insulator members 40, 42 have similar configurations which extend to cover only a portion of the conductors 18, 20, thereby allowing the conductors 18, 20 to be exposed to the interior of the box 24, creating connection points 44, 46. However, as the insulator members 40, 42 are offset, the connection points 44, 46 are also not aligned, thereby causing the connections points 44, 46 to be un-symmetrical and vertically offset. In the exemplary embodiment shown in FIGS. 8 through 10, the insulator members 40, 42 have different configurations (i.e. insulator member 40 is larger than insulator member 42 and extends out further from conductor 20) but are still positioned to create un-symmetrical, vertically offset connection points, 44, 46. In addition, insulator member 40 provides a stop surface 48 positioned in line with slot 32 to prevent improper insertion of a connector 100, as will be more fully described below.

One or more connectors 100 are provided to electrically connect the devices 16 to the grid elements 22 of the grid framework 14. For example, a connector assembly 100 provides a low voltage electrical connection between the conductors 18, on the grid framework 14 and a device 16 such as a light.

As shown in FIGS. 3 through 10, exemplary connector assemblies 100 for making a low voltage electrical connection between one or more devices 16 and conductors 18, 20 housed inside the lower box 24 of a grid element 22 is provided. Each connector assembly 100 provides the electrical interface required and the flexibility of attaching the connector assembly 100 to the box 24 of a respective grid element 22 at any position along the length of the grid box 24. In addition, the connector assembly 100 provides a robust mechanical connection with the grid element 22 and an electrical connection between the conductors 18, 20 and various devices 16. For a more detailed explanation of the various components of an exemplary connector, reference is made to co-pending U.S. patent application Ser. No. 13/309,600, filed Dec. 2, 2011, which is hereby incorporated by reference in its entirety.

Figure 9:
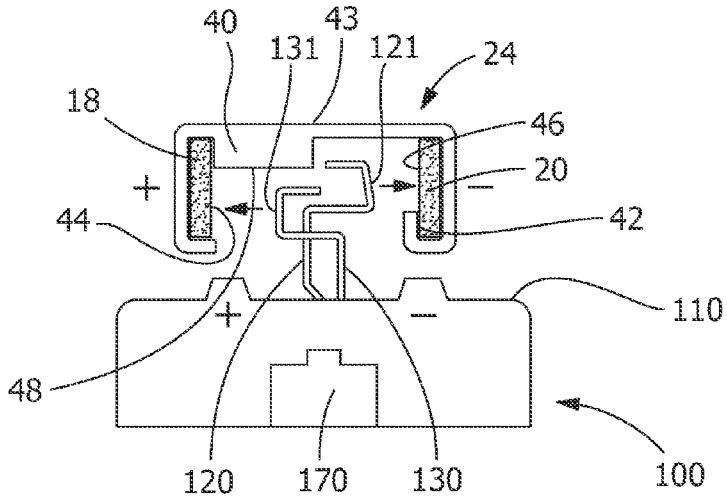
FIG. 9 shows an enlarged end view of the top portion of the connector of FIG. 8 with contacts inserted into the grid member.

An exemplary connector assembly 100 has a connector housing 102 which is molded from plastic or other material having the strength and electrically insulative properties required. A first or top surface 110 is configured to about against or be positioned proximate a respective flange 30 of the grid element 22, as best shown in FIGS. 5, 6 and 9.

First and second contacts 120, 121 are secured in the connector housing 102 and extend from the top surface 110. The contacts 120, 121 are movable between a mated and an unmated position. The first contact 120 has a contact portion 130 which is configured to make an electrical connection with the connection point 44 of conductor 18 when the first contact 120 is moved to a mating position. The second contact 121 has a contact portion 131 which is configured to make an electrical connection with the connection point 46 of conductor 20 when the second contact 121 is moved to a mating position. In the exemplary embodiment shown, the contact portion 131 of the second contact 121 is vertically offset from the contact portion 130 of the first contact 120, such that the contact portion 131 of the second contact 121 is offset from the top surface 110 a greater distance that the contact portion 130 of the first contact 120.

A cam member 170 is provided in the housing 102. In the exemplary embodiment shown, the cam member 170 is a linear member which extends in a direction parallel to the longitudinal axis of the housing 102. The cam member 170 extends through openings 172 provided at either end of the housing 102. The cam member 170 has camming surfaces (not shown) positioned on opposed side surface thereof. Operator engagement areas 176 are provided proximate the ends of the cam member 170. Other configurations of the cam member 170 may be used without departing from the scope of the invention.

Referring to FIGS. 4 through 6, when installing the connector assembly 100 on a respective grid element 22, the connector assembly 100 is moved toward the grid element 22 as indicated by the arrow of FIG. 4. As this occurs, the longitudinal axis of the assembly 100 is positioned essentially parallel to the longitudinal axis of the box 24 of the grid element 22. As assembly 100 is moved toward grid element 22, the contact portions 130, 131 of the contacts 120, 121 are inserted between flanges 30 into slot 32 of box 24. Insertion continues until the top surface 110 of the connector assembly 100 is in contiguous relation with the pair of flanges 30 of the box 24 which define the slot, such that the contacts 120, 121 are properly positioned in the slot 32, as is shown in FIG. 5. Other methods of insuring proper position of the contacts 120, 121 may be used, such as, but not limited to, the top of the contact 121 engaging the base wall 26.

With the assembly 100 properly inserted, an operator engages a respective operator engagement area 176, causing the cam member 170 to be moved from a first position, in which the camming surfaces do not engage the cam engagement sections of the contacts 120, 121, to a second position, in which the camming surfaces do engage the cam engagement sections of the contacts 120. 121. As this movement from the first position to the second position occurs, the camming surfaces cause the contacts 120, 121 and the contact portions 130, 131 to be biased outward in a direction toward the sidewalls 28 of the grid element 22, moving the contacts 120, 121 and the contact portions 130, 131 from the unmated position toward the mated position.

As shown in FIG. 6, if the connector housing 102 is properly oriented, such that the polarity of the connector corresponds to the polarity of the conductors 18, 20, when the cam member 170 is in the second position, the contact portions 130, 131 will be moved to the mated position in which the contact portions 130, 131 engage the connection points of the conductors 18, 20 of the box 24, thereby providing an electrical connection between the conductors 18, 20 and the contact 120, 121. As the contacts 120, 121 are resiliently deformable, the contacts 120, 121 will provide sufficient force to maintain a positive electrical connection between the conductors 18, 20 and the contact portions 130, 131. The resiliency of the contacts 120, 121 also allows the contacts 120, 121 and contact portions 130, 131 to compensate for any irregularities in the conductors 18, 20.

Figure 7:
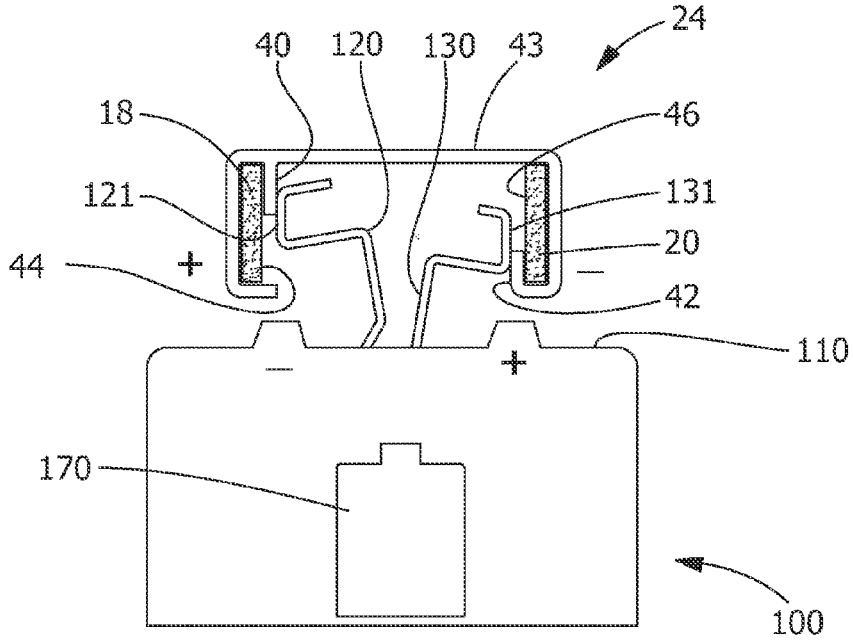
FIG. 7 shows an enlarged end view of the top portion of the connector with the contacts spread apart, however, the contacts do not make an electrical connection with the bus bars, as the contacts are improperly oriented relative to the bus bars.

Alternatively, as shown in FIG. 7, if the connector housing 102 is not properly oriented, i.e. the polarity of the connector does not correspond to the polarity of the conductors 18, 20, the contact portions 130, 131 will not engage the connection points of the conductors 18, 20 of the box 24 when the cam member 170 is moved toward the second position. Instead, the contact portions 130, 131 will engage the insulator members 40, 42, thereby prohibiting an electrical connection between the conductors 18, 20 and the contacts 120, 121. This prevents the connector 100 form being improperly oriented relative to the conductors 18, 20. In one exemplary embodiment, the engagement of the contact portions 130, 131 with the insulator members 40, 42 causes sufficient resistance to prevent the cam member 170 from being moved fully to the second position, thereby providing the operator with a physical indication that the connector is not properly installed. In another embodiment, the cam member 170 may be allowed to move to the second position. However, as the contact portions 130, 131 do not engage the conductors 18, 20, the connector will not function until the connector is properly installed.

Figure 8:
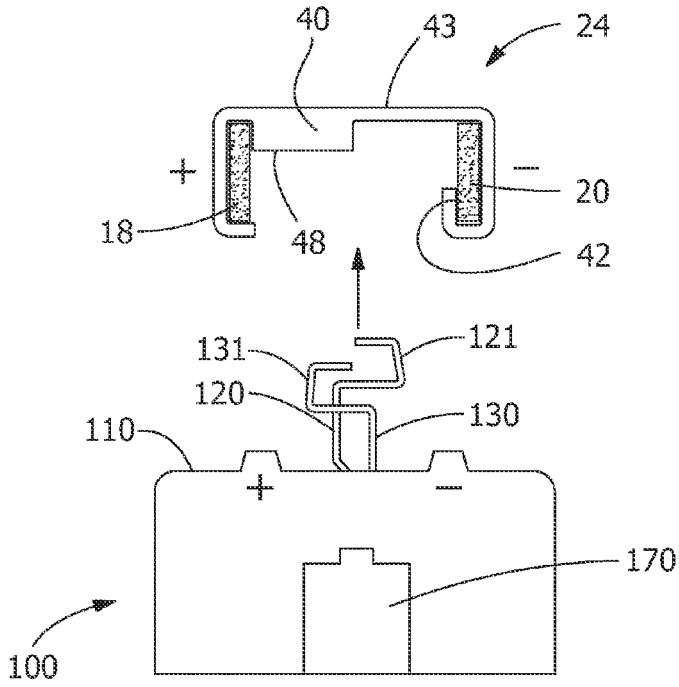
FIG. 8 shows an enlarged end view of a top portion of an alternate exemplary connector prior to insertion into an alternate exemplary grid member which has bus bars provided thereon.

Referring to FIGS. 8 through 9, when installing the connector assembly 100 on a respective grid element 22, the connector assembly 100 is moved toward the grid element 22 as indicated by the arrow of FIG. 8. As this occurs, the longitudinal axis of the assembly 100 is positioned essentially parallel to the longitudinal axis of the box 24 of the grid element 22. As assembly 100 is moved toward grid element 22, the contact portions 130, 131 of the contacts 120, 121 are inserted between flanges 30 into slot 32 of box 24. Insertion continues until the top surface 110 of the connector assembly 100 is in contiguous relation with the pair of flanges 30 of the box 24 which define the slot, such that the contacts 120, 121 are properly positioned in the slot 32, as is shown in FIG. 5. Other methods of insuring proper position of the contacts 120, 121 may be used, such as, but not limited to, the top of the contact 121 engaging the base wall 26.

With the assembly 100 properly inserted, an operator engages a respective operator engagement area 176, causing the cam member 170 to be moved from a first position, in which the camming surfaces do not engage the cam engagement sections of the contacts 120, 121, to a second position, in which the camming surfaces do engage the cam engagement sections of the contacts 120. 121. As this movement from the first position to the second position occurs, the camming surfaces cause the contacts 120, 121 and the contact portions 130, 131 to be biased outward in a direction toward the sidewalls 28 of the grid element 22.

If the connector housing 102 is properly oriented, such that the polarity of the connector corresponds to the polarity of the conductors 18, 20, when the cam member 170 is in the second position, the contact portions 130, 131 will engage the connection points of the conductors 18, 20 of the box 24, thereby providing an electrical connection between the conductors 18, 20 and the contact 120, 121. As the contacts 120, 121 are resiliently deformable, the contacts 120, 121 will provide sufficient force to maintain a positive electrical connection between the conductors 18, 20 and the contact portions 130, 131. The resiliency of the contacts 120, 121 also allows the contacts 120, 121 and contact portions 130, 131 to compensate for any irregularities in the conductors 18, 20.

Figure 10:
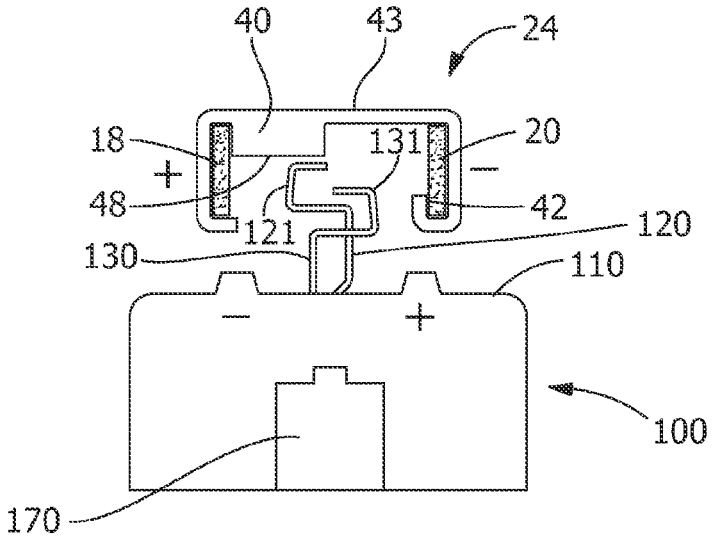
FIG. 10 shows an enlarged end view of the top portion of the connector of FIG. 8 which is not properly inserted into the grid member, as the contacts are improperly oriented and cannot be fully inserted into the grid member.

Alternatively, as shown in FIG. 10, if the connector housing 102 is not properly oriented, i.e. the polarity of the connector does not correspond to the polarity of the conductors 18, 20, the contact portions 130, 131 cannot be fully inserted into the slot 32, as the contact portion 131 will engage the stop surface 48 which is provided proximate the slot 32. In this position, the flanges 30 prevent the movement of the contact portions 130, 131 to the second portion. This prevents the improper oriented contact portions 130, 131 to be fully inserted into the grid element 22, thereby preventing the contact portions 130, 131 from engaging the connection points of the conductors 18, 20 of the box 24 when the cam member 170 is moved toward the second position. This prevents the connector 100 form being improperly oriented relative to the conductors 18, 20. In addition, if the connector housing 102 is not properly oriented, the contact portions 130, 131 will not engage the connection points of the conductors 18, 20 of the box 24 when the cam member 170 is moved toward the second position. Instead, the contact portions 130, 131 will engage the insulator members 40, 42, thereby prohibiting an electrical connection between the conductors 18, 20 and the contacts 120, 121. In one exemplary embodiment, the engagement of the contact portions 130, 131 with the insulator members 40, 42 causes sufficient resistance to prevent the cam member 170 from being moved fully to the second position, thereby providing the operator with a physical indication that the connector is not properly installed. In another embodiment, the cam member 170 may be allowed to move to the second position. However, as the contact portions 130, 131 do not engage the conductors 18, 20, the connector will not function until the connector is properly installed.

Figure 11:
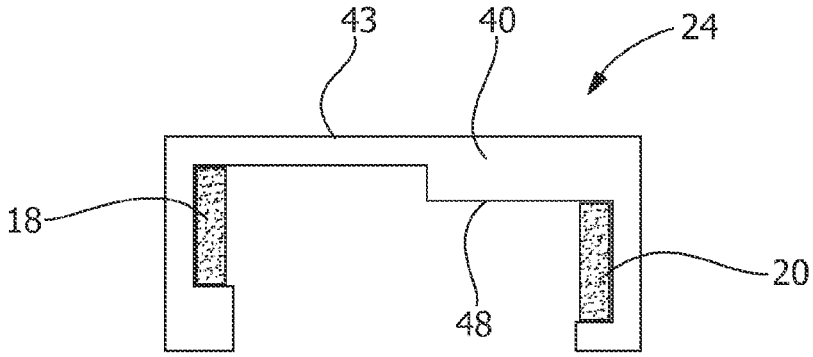
FIG. 11 shows an enlarged end view of an alternate exemplary grid member which has bus bars provided thereon.

Alternatively, only one insulator member 40 may be provided. In this embodiment, as shown in FIG. 11, the contact portions 130, 131 cannot be fully inserted into the slot 32, as the contact portion 131 will engage the stop surface 48 of the insulator member 42 which is provided proximate the slot 32. In this position, the flanges 30 prevent the movement of the contact portions 130, 131 to the second portion. This prevents the improper oriented contact portions 130, 131 to be fully inserted into the grid element 22, thereby preventing the contact portions 130, 131 from engaging the connection points of the conductors 18, 20 of the box 24 when the cam member 170 is moved toward the second position. This prevents the connector 100 from being improperly oriented relative to the conductors 18, 20.

In any of the exemplary embodiments, with the assembly 100 properly oriented and mounted to the grid element 22, a low voltage electrical device may be mounted to the assembly 100, thereby establishing an electrical connection between the conductors 18, 20 and the low voltage device.

If the device is no longer needed, the device may be removed from the assembly 100. The assembly 100 may then be removed from the grid element 22. Alternatively, the assembly 100 may be removed from the grid element with the device still attached. In order to remove the assembly 100, the cam member 170 is moved from the second position back to the first position. As this occurs, the contacts 120, 121 are allowed to return to their unbiased positions, thereby causing the contact portions 130, 131 to move away from the sidewalls 28 of the grid element 22 and to disengage from the flanges 30. This allows for the withdraw of the contact portions 130, 131 from the slot 32.

While the exemplary embodiments shown have one or more insulator members 40, 42 which prevent electrical connection if the polarity between the connector and the conductors are not proper, other methods may be used, such as modifying the configuration of the conductors or modifying the configuration of the conductors and the insulator members.

The use of asymmetrical and offset contact points ensures that the connector assemblies will only make an electrical connection with the conductors if the assembly is properly mounted to the electrified grid. This eliminates the need for secondary polarity protection/compensation schemes in the assembly. This also decreases the possibility of damage to the low voltage devices which are connected to the connector assembly.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector for installation on a ceiling grid having conductors therein, the connector comprising:

a housing having a first surface;

a first contact secured in the housing, the first contact having a first contact portion which extends from the first surface;

a second contact secured in the housing, the second contact having a second contact portion which extends from the first surface, the second contact portion being offset from the first surface a greater distance that the first contact portion;

wherein the first and second contact portions will only be placed in electrical connection with respective connection points of the conductors of the ceiling grid when the first and second contact portions are properly aligned, thereby insuring proper polarity between the first and second contact portions and the conductors.

2. The connector as recited in claim 1, wherein the first and second contacts are moveable between an unmated position in which first and second contact portions are not placed in electrical engagement with the conductors and a mated position in which the first and second contact portions are place in electrical engagement with the conductors.

3. The connector as recited in claim 1, wherein a cam member is provided in the housing, the cam member being movable between a first position, in which the cam member allows the first and second contacts to be in the unmated position and a second position, in which the cam member causes the first and second contacts to be in the mated position.

4. The connector as recited in claim 3, wherein the cam member extends through openings in opposed side walls of the housing.

5. The connector as recited in claim 3, wherein the cam member has camming surfaces which cooperate with the first and second contacts as the cam member is moved from the first position to the second position.

6. The connector as recited in claim 3, wherein the cam member is a linear member which extends in a direction which is essentially parallel to a longitudinal axis of the connector.

7. An electrified grid element, the grid element comprising:

a base wall, two side walls extending from the base wall, and flanges extending from the side walls;

a first conductor positioned proximate a first respective side wall and a second conductor positioned proximate a second respective side wall, the first conductor having an opposite polarity to the second conductor;

insulator members positioned proximate the side walls, the insulator members cooperate with a mating connector to prevent the mating connector from engaging the first and second conductors if the polarity of the mating connector does not correspond to the polarity of the first and second conductors.

8. The electrified grid element as recited in claim 7, wherein the first conductor and second conductor are conductive strips.

9. The electrified grid element as recited in claim 7, wherein a first insulator member is positioned proximate the first conductor, the first insulator member is positioned proximate the flange and extends from proximate the first conductor toward the second conductor.

10. The electrified grid element as recited in claim 9, wherein a second insulator member is positioned proximate the second conductor, the second insulator member is positioned proximate the base wall and extends from proximate the second conductor toward the first conductor.

11. The electrified grid element as recited in claim 10, wherein the second insulator member has a stop surface positioned in line with a slot formed between the flanges.

12. The electrified grid element as recited in claim 7, wherein a first insulator member is attached to an isolation member which provides electrical isolation between the conductors and the base wall, side walls and flanges.

13. The electrified grid element as recited in claim 12, wherein the first insulator member is integrally molded to the isolation member.

14. A connection system comprising:

a connector comprising:

a housing having a first surface;

a first contact secured in the housing, the first contact having a first contact portion which extends from the first surface;

a second contact secured in the housing, the second contact having a second contact portion which extends from the first surface, the second contact portion is offset from the first surface a greater distance that the first contact portion;

an electrified grid element comprising:

a first conductor and a second conductor, the first conductor having an opposite polarity to the second conductor;

a first insulator member positioned proximate the first conductor and a second insulator member positioned proximate the second conductor, the first insulator member being offset from the first surface of the housing a greater distance that the second insulator member;

wherein the first and second insulator members prevent the mating of the connector to the electrified grid element unless the connector is properly oriented in the electrified grid member, thereby insuring proper polarity between the connector and the electrified grid element.

15. The connector as recited in claim 14, wherein the first and second contacts are moveable between an unmated position in which first and second contact portions are not placed in electrical engagement with connection portions of the first and second conductors and a mated position in which the first and second contact portions are place in electrical engagement with the connection portions of the first and second conductors.

16. The connector as recited in claim 15, wherein a cam member is provided in the housing, the cam member being movable between a first position, in which the cam member allows the first and second contacts to be in the unmated position and a second position, in which the cam member causes the first and second contacts to be in the mated position.

17. The electrified grid element as recited in claim 14, wherein the first conductor and second conductor are conductive strips.

18. The electrified grid element as recited in claim 14, wherein the second insulator member has a stop surface positioned in line with a slot formed between flanges of the electrified grid element.

19. The electrified grid element as recited in claim 14, wherein the first insulator member is attached to an isolation member which provides electrical isolation between the first conductor and a base wall, side walls and flanges of the electrified grid element.

20. The electrified grid element as recited in claim 19, wherein the first insulator member is integrally molded to the isolation member.

* * * * *